US008708178B2

(12) United States Patent
Kvols et al.

(10) Patent No.: US 8,708,178 B2
(45) Date of Patent: Apr. 29, 2014

(54) CONTAINER SYSTEM AND METHOD

(75) Inventors: Kevin Kvols, Steamboat Springs, CO (US); Stephen Schloesser, Colorado Springs, CO (US)

(73) Assignee: Diversified Fixtures, Inc., Colorado Springs, CO (US)

( * ) Notice: Subject to any disclaimer, the term of this patent is extended or adjusted under 35 U.S.C. 154(b) by 0 days.

(21) Appl. No.: 13/558,162

(22) Filed: Jul. 25, 2012

(65) Prior Publication Data

US 2013/0026165 A1 Jan. 31, 2013

Related U.S. Application Data

(60) Provisional application No. 61/511,951, filed on Jul. 26, 2011.

(51) Int. Cl.
*B65D 6/00* (2006.01)

(52) U.S. Cl.
USPC ..... 220/4.33; 220/4.28; 220/666; 206/600

(58) Field of Classification Search
USPC ..... 220/4.28, 4.29, 4.33, 4.34, 647, 649, 220/666, 676; 206/600
See application file for complete search history.

(56) References Cited

U.S. PATENT DOCUMENTS 2,233,671 A * 3/1941 Lopes, Jr. ..... 217/65
2,388,297 A 11/1945 Slaughter
2,775,361 A * 12/1956 Kasdan ..... 220/4.33
2,896,808 A * 7/1959 Papy et al. ..... 217/66
3,039,641 A * 6/1962 Rosan ..... 217/113
3,082,897 A * 3/1963 Highley ..... 217/65
3,235,118 A * 2/1966 Kewley ..... 217/65
3,323,674 A * 6/1967 Nist, Jr. ..... 217/12 R
3,349,533 A 10/1967 Gregoire
3,466,710 A * 9/1969 Kupersmit ..... 24/347
3,712,499 A 1/1973 Talbert
3,894,717 A * 7/1975 Elmore et al. ..... 251/144
3,945,601 A * 3/1976 Rowley ..... 249/48
3,990,599 A * 11/1976 Rowley ..... 217/12 R
4,024,977 A * 5/1977 Rowley ..... 217/12 R
4,062,301 A * 12/1977 Pitchford ..... 108/56.1
4,083,464 A * 4/1978 Burnett ..... 217/13
4,139,113 A * 2/1979 Graham, Jr. ..... 217/12 R
4,140,040 A * 2/1979 Modrey ..... 411/45
4,245,774 A * 1/1981 Heinz, Jr. ..... 229/102
4,449,662 A 5/1984 Okamura et al.
4,453,471 A * 6/1984 Harrington et al. ..... 108/55.1
4,461,395 A * 7/1984 Burnett ..... 217/12 R
4,557,091 A 12/1985 Auer (Continued)

FOREIGN PATENT DOCUMENTS

GB 2299132 9/1996
GB 2347668 9/2000

(Continued)

*Primary Examiner* — Anthony Stashick
*Assistant Examiner* — Christopher McKinley
(74) *Attorney, Agent, or Firm* — Knobbe Martens Olson & Bear LLP

(57) ABSTRACT

A container assembly can have a plurality of sides. Two or more of the sides has one or more grooves. An insert can be installed into one or more of the grooves. Clips can be used to connect groove(s) and/or insert(s) on one side of the container assembly to groove(s) and/or insert(s) on another side of the container assembly.

22 Claims, 12 Drawing Sheets

(56) References Cited

U.S. PATENT DOCUMENTS

| | | | | |
|---|---|---|---|---|
| 4,609,116 | A * | 9/1986 | Simms | 217/12 R |
| 4,779,751 | A * | 10/1988 | Munroe | 217/69 |
| 4,796,392 | A * | 1/1989 | Graham, Jr. | 52/79.5 |
| 4,914,874 | A * | 4/1990 | Graham, Jr. | 52/79.1 |
| 5,050,793 | A * | 9/1991 | Graham, Jr. | 229/125.23 |
| 5,193,701 | A * | 3/1993 | Bush et al. | 220/4.33 |
| 5,311,996 | A | 5/1994 | Duffy et al. | |
| 5,535,909 | A * | 7/1996 | Philip | 220/4.33 |
| 5,555,980 | A | 9/1996 | Johnston et al. | |
| D375,201 | S | 11/1996 | Karr et al. | |
| 5,597,084 | A * | 1/1997 | Parasin | 220/4.28 |
| 5,617,967 | A * | 4/1997 | Neidhart | 220/4.33 |
| 5,647,181 | A | 7/1997 | Hunts | |
| 6,003,449 | A * | 12/1999 | Manidis | 108/54.1 |
| 6,006,480 | A | 12/1999 | Rook | |
| D423,220 | S | 4/2000 | McDade | |
| 6,203,235 | B1 * | 3/2001 | Bonde | 403/321 |
| 6,216,899 | B1 * | 4/2001 | Vicari | 220/1.5 |
| 6,299,011 | B1 | 10/2001 | Rosenfeldt | |
| D473,052 | S * | 4/2003 | Dehenau | D3/273 |
| 6,598,756 | B1 * | 7/2003 | Rosenfeldt | 220/4.28 |
| 6,604,328 | B1 | 8/2003 | Paddock | |
| D496,530 | S * | 9/2004 | Wolf | D3/273 |
| 6,843,025 | B2 | 1/2005 | Paz | |
| D501,720 | S | 2/2005 | Hussaini et al. | |
| 7,004,344 | B2 * | 2/2006 | Fulton et al. | 220/4.31 |
| 7,395,634 | B2 | 7/2008 | Anderson et al. | |
| D594,657 | S | 6/2009 | McAlpine | |
| 7,552,826 | B2 * | 6/2009 | Watanabe | 206/600 |
| D668,050 | S | 10/2012 | Kvols et al. | |
| D668,459 | S | 10/2012 | Kvols et al. | |
| D677,468 | S | 3/2013 | Kvols et al. | |
| D677,898 | S | 3/2013 | Kvols et al. | |
| 2002/0040903 | A1 * | 4/2002 | Coones | 220/4.33 |
| 2004/0074158 | A1 | 4/2004 | De Zen | |
| 2009/0013615 | A1 | 1/2009 | Kitagawa | |
| 2010/0170873 | A1 * | 7/2010 | Lopez | 217/12 R |
| 2011/0197521 | A1 | 8/2011 | Courtney | |
| 2013/0067846 | A1 | 3/2013 | Kvols et al. | |
| 2013/0192155 | A1 | 8/2013 | Bergeron | |

FOREIGN PATENT DOCUMENTS

| | | |
|---|---|---|
| WO | WO 92/21574 | 12/1992 |
| WO | WO 93/17930 | 9/1993 |
| WO | WO 03/106279 | 12/2003 |

* cited by examiner

CONTAINER SYSTEM AND METHOD

CROSS-REFERENCE TO RELATED APPLICATIONS

The present application claims priority under 35 U.S.C. §119(e) to U.S. Provisional Application No. 61/511,951 filed on Jul. 26, 2011, the disclosure of which is incorporated by reference herein in its entirety and is to be considered party of this specification.

BACKGROUND

1. Field

Certain embodiments disclosed herein relate generally to container systems. In particular, the container systems can be collapsible containers used for many different purposes including storage and/or shipping.

2. Description of the Related Art

Collapsible containers are commonly used in the shipping industry. Collapsible containers may be reused and the collapsibility of shipping containers can help reduce storage and/or waste disposal costs for those receiving shipments. Collapsibility can also increase the customizability of shipping containers.

SUMMARY

Accordingly, there is a continued need for improved containers, such as collapsible shipping containers, and container assembly/disassembly methods, among other things.

Preferably, a container includes a plurality of wall portions. The wall portions can fit together and be can secured via clips that engage with adjacent wall portions. The wall portions can include one or more inserts that each fits within a groove or notch in a wall portion. In such embodiments, the clips can have engagement portions (e.g., crimped ends, protrusions, hooks, etc.) that connect to and/or fit within the inserts.

In some embodiments a collapsible container assembly can include a plurality of sides, a plurality of inserts, and at least one clip. The plurality of sides can be configured to connect and disconnect to form a collapsible container. Each side has an internal surface and an external surface. At least two of the sides can have at least one groove in their external surfaces. Each insert can be configured for placement within one of the grooves. Each insert can have a base portion and a flange portion, the base portion having a mating surface and at least one internal surface, the mating surface configured to engage with the grooves, the flange portion extending outwardly from at least a portion of a periphery of the base portion, the flange portion having an outer periphery, the outer periphery positioned outside the groove when the insert is installed within the groove. The at least one clip can have a general L-shape with two ends, each of the two ends having an engagement feature configured to engage with and to be received into the at least one internal surface of an insert.

According to some embodiments, collapsible container assembly can include a plurality of sides configured to connect and disconnect to form a collapsible container, each side having an internal surface and an external surface, at least two of the sides having at least one slot on their external surfaces. The container can also include a plurality of inserts and at least one clip. Each insert can be configured to fit within one of the plurality of slots and can have a base portion and a flange portion. The base portion can fit within one of the slots and the flange portion can extend from the base portion, being configured to be positioned outside of the slot. The at least one clip can have a first end and a second end, each end having an engagement feature configured to engage with at least one of the plurality of inserts positioned within one of the slots of the plurality of sides.

A method of assembling a collapsible container assembly can include: selecting a first side member having a plurality of first side edges and a plurality of first side slots, each first side slot positioned on an outwardly-facing surface of the first side member and adjacent a first side edge, at least one of the first side slots including an insert installed within the at least one first side slot; selecting a second side member having a plurality of second side edges and a plurality of second side slots, each second side slot positioned on an outwardly-facing surface of the second side member and adjacent a second side edge, at least one of the second side slots including an insert installed within the at least one second side slot; positioning the second side member perpendicular to the first side member with one of the first side edges adjoining one of the second side edges; and connecting a clip to the insert installed within the at least one first side slot and to the insert installed within the at least one second side slot.

Certain embodiments of the method may include: installing at least one insert into at least one of the at least one first side slot and the at least one second side slot.

Certain embodiments of the method may include: selecting a third side member having a plurality of third side edges and a plurality of third side slots, each third side slot positioned on an outwardly-facing surface of the third side member and adjacent a third side edge, at least one of the third side slots including an insert installed within the at least one third side slot; positioning the third side member perpendicular to both the first side member and the second side member one of the first side edges adjoining one the third side edges and one of the second side edges adjoining one of the third side edges; and connecting a clip to the insert installed within the at least one third side slot and to the insert installed within the at least one second side slot.

BRIEF DESCRIPTION OF THE DRAWINGS

These and other features, aspects and advantages are described below with reference to the drawings, which are intended to illustrate but not to limit the invention. In the drawings, like reference characters denote corresponding features consistently throughout similar embodiments.

DETAILED DESCRIPTION

Figure 1:
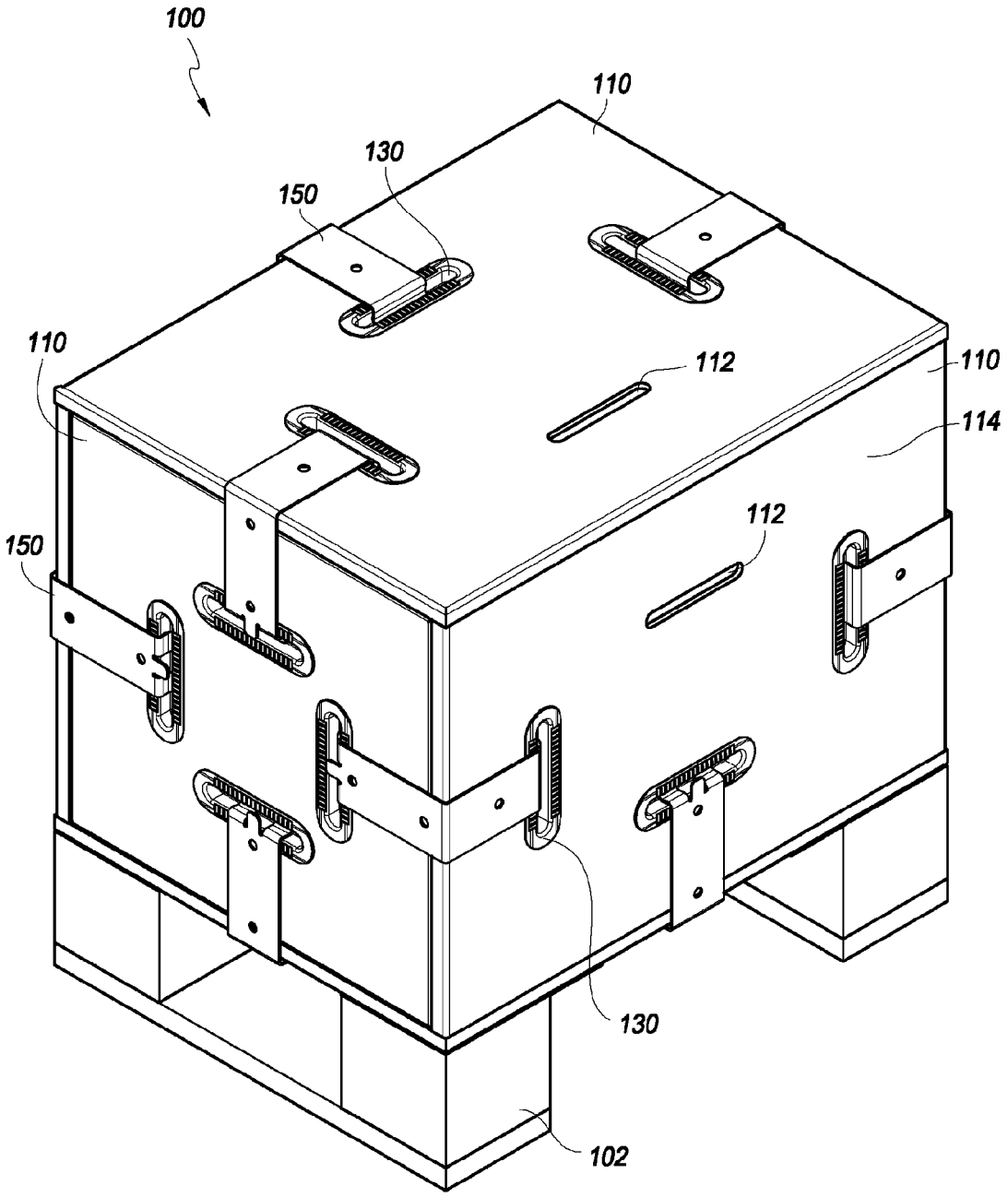
FIG. 1 is a perspective view of a container assembly.

FIG. 1 illustrates an embodiment of a container 100. It should be understood that the illustrated container includes each of the features designated by the numbers used herein. However, as emphasized repeatedly herein, these features need not be present in all embodiments. It will also be understood that the principles of the system and methods described herein can be employed for other uses besides containers, including, but not limited to, shelving, buildings, animal shelters, and furniture.

In various embodiments, the container has a generally cubic shape, has a generally cylindrical shape, is a rectangular prism, or has any other shape. Each wall of the container can comprise a single side portion or a plurality of side portions. Additionally, each wall can comprise a single groove, a plurality of grooves, or no grooves. Other configurations are also possible for the container. In some embodiments, the container includes one or more handles or other features for assisting with transport of the container.

In some configurations, the container assembly 100 comprises a collapsible container. The collapsible container can be assembled and disassembled without the use of fasteners (e.g., nails, tacks, screws, bolts, etc.) or adhesives (e.g., glue, tape, epoxy, welding, etc.). The collapsible container can be reusable. For example, the collapsible container can be put together, shipped, disassembled, stored, put back together, and shipped again. Of course these steps are not required, but offer an example of how a collapsible container may be used. Non-collapsible containers and non-collapsible components of the container are also anticipated, such containers and components being assembled using adhesive and/or fasteners.

Figure 13:
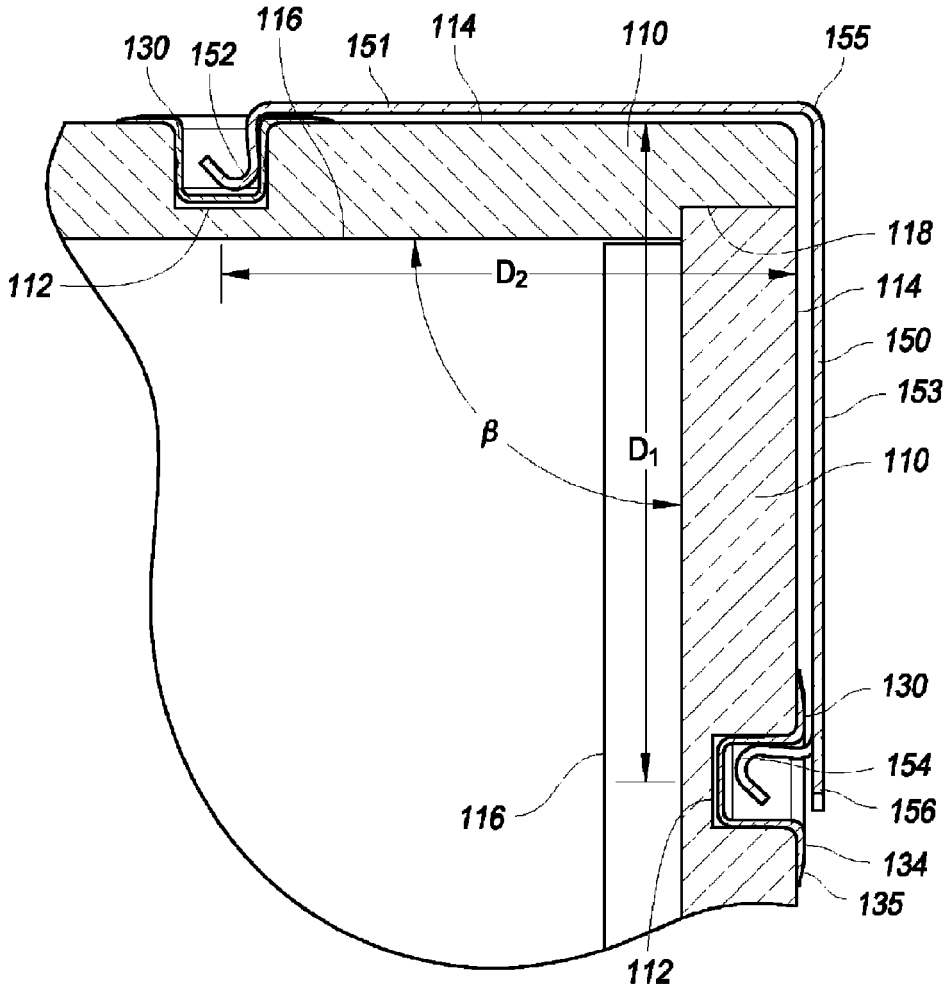
FIG. 13 is a partial cross-section view of the container assembly of FIG. 1 along the cut plane 13-13 of FIG. 12.

In certain embodiments, the container assembly 100 comprises a plurality of sides 110. Each side 110 can comprise a single side portion, as illustrated in FIG. 1, of a plurality of side portions connected to each other. For example, one or more of the sides 110 could comprise two or more side portions connected to each other via adhesives, fasteners, welding, or other methods of connection. Each side 110 can have an exterior surface 114 and an interior surface 116 (FIG. 13). In some embodiments, one of the sides 110 includes a two-way pallet base or a four-way pallet base 102, as illustrated in FIG. 1. The interior of the container assembly 100 can include a custom dunnage design, one or more shelves, and/or padded interior surfaces 116, among other features.

Continuing to refer to FIG. 1, the sides 110 of the container assembly 100 can include one or more grooves or slots 112 among other surface features. The container assembly 100 can include a plurality of clips 150. The clips 150 can be sized and shaped to engage with pairs of grooves 112 in different sides 110 (e.g., opposing or adjacent) of the container assembly 100. In the illustrated arrangement, the clips 150 engage with pairs of grooves 112 in adjacent sides 110. Inserts 130 can be configured to at least partially fit within the grooves 112. Preferably, the clips 150 are configured to engage with inserts 130 installed in the grooves 112. Engagement between the clips 150 and the inserts 130 and/or grooves 112 can secure adjacent sides 110 to each other and enable secure construction of the container assembly 100.

In certain embodiments, each of the sides 110 has the same shape and size as each other side 110. In such embodiments, the container assembly 100 can have a cubic shape. In other embodiments, the shapes, lengths, and/or widths of the plurality of sides 110 can vary from one another and, in some configurations, the plurality of sides 110 can be assembled to produce containers 100 with shapes other than cubes and rectangular prisms. For example, without limitation, the container assembly 100 can have a cylindrical shape, a triangular prism shape, or any other similar shape.

Figure 2:
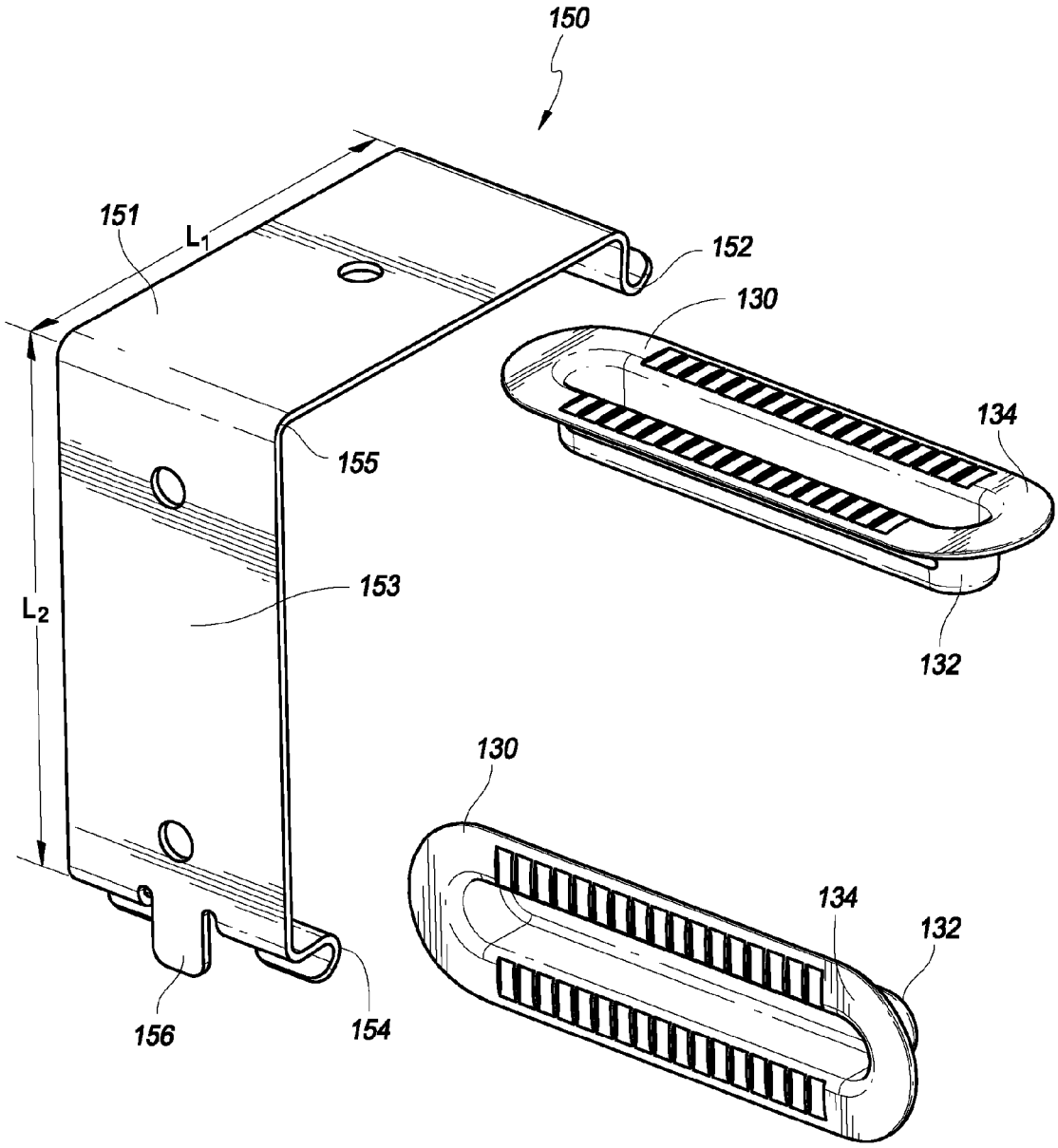
FIG. 2 is an exploded view of a clip and corresponding inserts.

FIG. 2 illustrates a clip 150 and two corresponding inserts 130. The clip 150 has a first engagement feature 152 configured to engage with an insert 130 and/or with a groove 112 in the exterior surface of a side 110 of the container assembly 100. The clip 150 can have a second engagement feature 154 configured to engage with an insert 130 and/or with a groove 112 in the exterior surface of a side 110 of the container assembly 100. In some embodiments, one of the first and second engagement features 152, 154 is configured to engage with an insert 130 and the other is configured to engage directly with a groove 112 in the exterior surface of a side 110 of the container assembly 100. It will be understood that though a particular style of clip is described, any of number of different clips could be used. For example a CLIP-LOK Brand clip or other type of clip could be used. In addition the container could use one or more different styles or types of clips. Inserts may or may not be used with these clips.

Each insert 130 can include a base 132 and a flange portion 134. The base 132 can be configured to engage with and receive the first and/or second engagement features 152, 154 of the clip 150. Furthermore, the base 132 can be configured to fixedly and/or releasably engage with the grooves 112 in the exterior surface 114 of the sides 110 of the container assembly 100.

Figure 3:
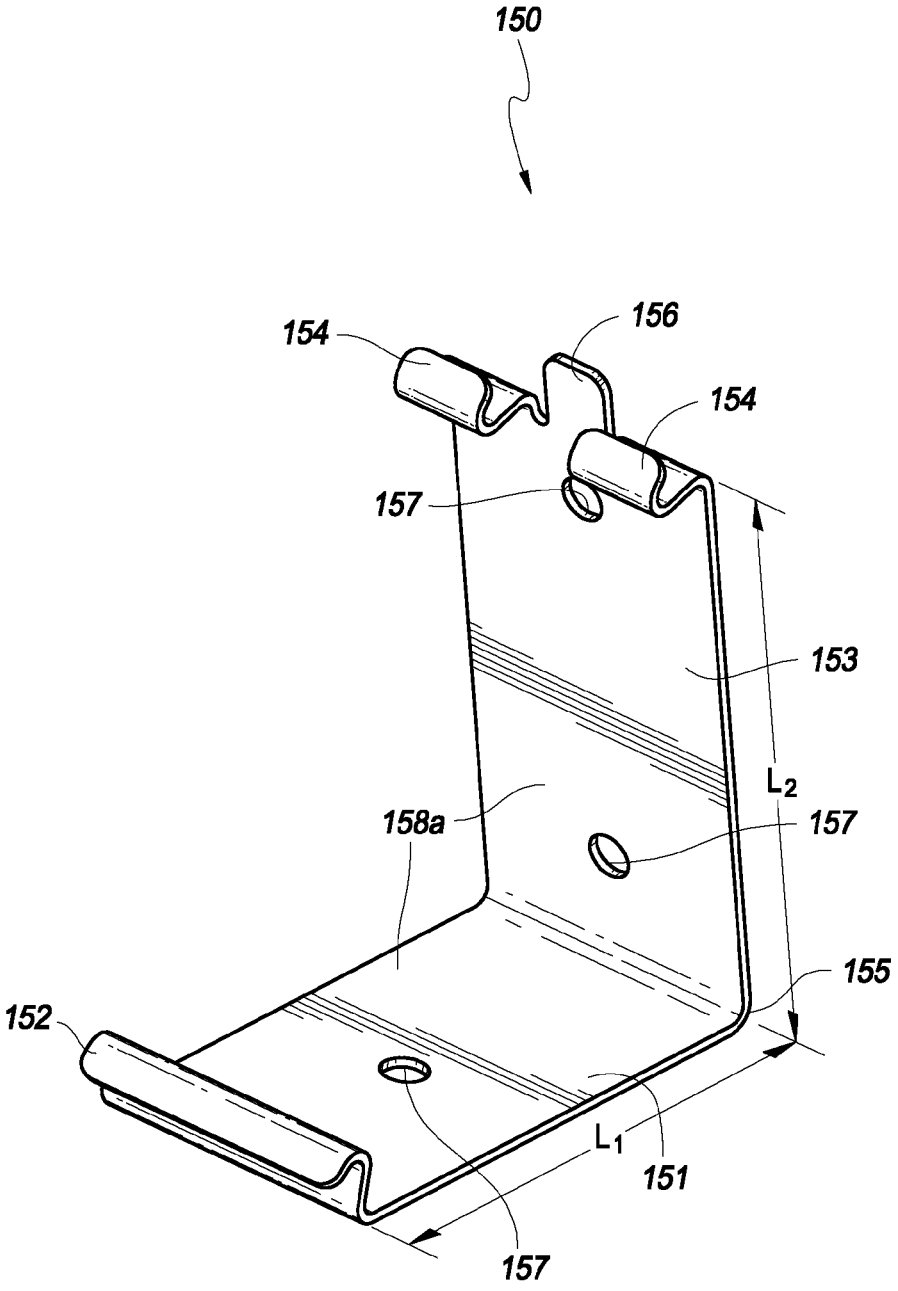
FIG. 3 is a perspective view of a clip.
Figure 4:
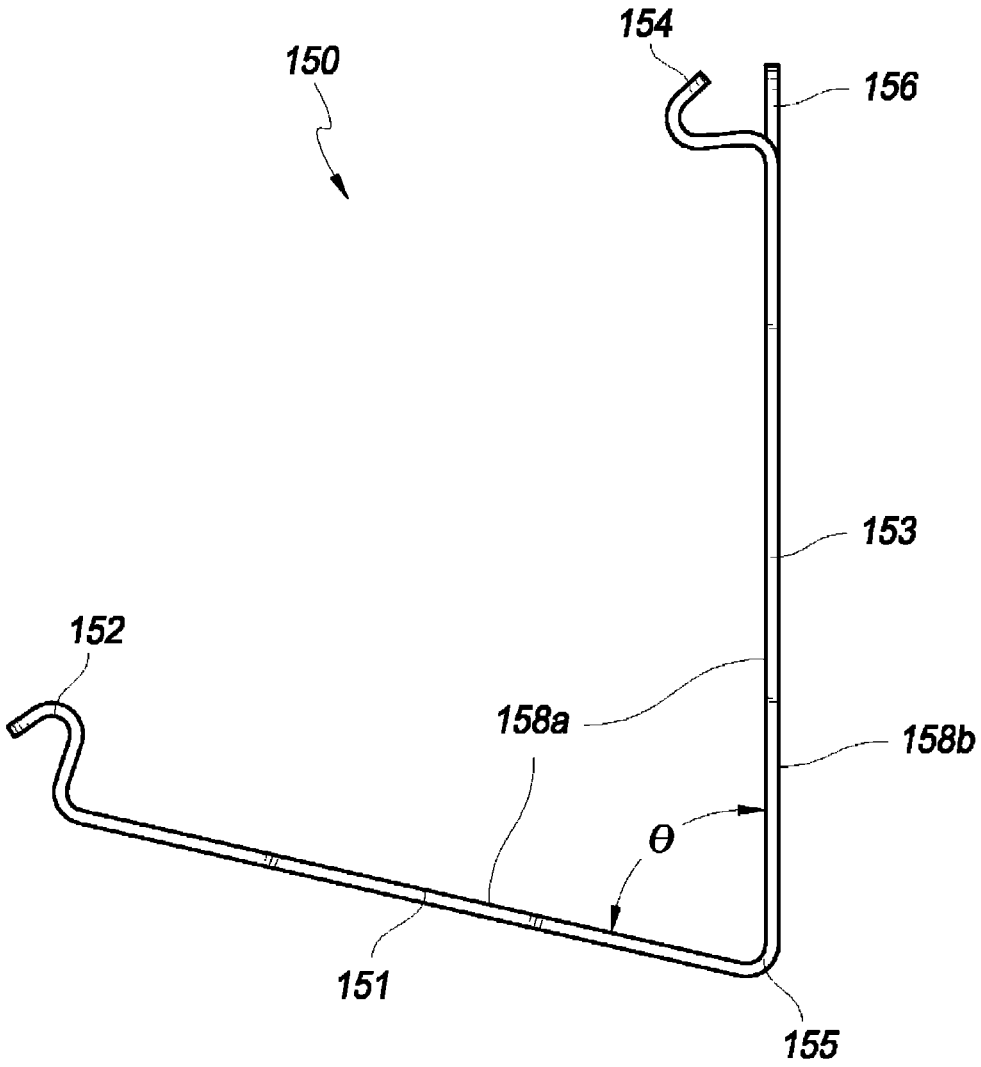
FIG. 4 is a side view of the clip of FIG. 3.

FIGS. 2-4 illustrate an embodiment of the clip 150 that has a general L- or V-shape. A bend 155 in the clip 150 defines the boundary between a first clip portion or leg 151 and a second clip portion 153. The first clip portion 151 can have a length L1 and the second clip portion or leg 153 can have a length L2. In some embodiments, L1 and L2 are approximately the same. In some embodiments, one of L1 and L2 is greater than the other. It is contemplated that clips 150 having more than one bend 155 and/or more than two clip portions may be used. Furthermore, clips 150 with no bends may be used, for example, to connect two parallel and adjacent sides 110 or portions of sides of a container assembly 100.

In some applications, the bend 155 can have a small (e.g., 5-10% of L1 and/or L2) radius of curvature, as illustrated, a negligible radius of curvature (e.g., a kink in the clip 150), or a large (e.g., 10-30% of L1 and/or L2) radius of curvature. In some embodiments, the clip 150 has a generally curved shape (e.g., the radius of curvature is equal to at least one of L1 and L2). Bends with certain radii of curvature can be appropriate for certain container assemblies 100. For example, a generally curved-shape clip 150 could be useful and appropriate for connecting two curved sides 110 of a container assembly 100 to each other as the shape of the clip 150 can be generally aligned with the shape of the container assembly 100. Similarly, bends 155 with a small or negligible radius of curvature may be useful and appropriate for connecting two perpendicular sides 110 of a container assembly 100.

An angle $\theta$ between the first clip portion 151 and the second clip portion 153 can be greater than about 45° and/or less than about 135° when the clip 150 is in a disconnected state (e.g., not engaged with inserts 130 or grooves 112). In some embodiments, the angle $\theta$ is approximately 75° when the clip 150 is in the disconnected state. As illustrated in FIG. 13, clips 150 can be used to adjoin two sides 110 of a container assembly 100 at an angle $\beta$. Preferably, the angle $\theta$ between the first and second clip portions 151, 153 for a given clip 150 is less than the angle $\beta$ between the two sides 110 being connected by such a clip 150. In such cases, the clip 150 must be widened (e.g., the angle θ must be increased) in order to fit the clip 150 onto the two sides 110. As such, the bending stress in the clip 150 due to the widening of the clip 150 can bias the first and second engagement features 152, 154 into the grooves 112 and/or inserts 130 on the exterior surfaces 114 of the adjoining sides 110. Such a biasing force helps the clip 150 to stay in place and secure the two sides 110 to each other.

The first and second engagement features 152, 154 can comprise many different and/or alternative means for engaging with a groove 112 and/or an insert 130 in the exterior surface 114 of a side 110 of a container assembly 100. For example, as illustrated in FIGS. 2-4, the first engagement feature 152 can comprise one or more bends at or near the end of the first clip portion 151 opposite the bend 155. In such embodiments, the engagement feature 152 can have a general U-shaped cross-sectional shape. Such a U-shape can be advantageous for a number of reasons. For example, a U-shaped engagement feature 152 can help reduce friction between the engagement feature 152 and the exterior surface 114 of a side 110 as the clip 150 is snapped into place. Furthermore, the U-shape of the engagement feature 152 can flex to facilitate a tight fit of the engagement feature 152 within an insert 130 or groove 112.

With reference again to FIGS. 2-4, the second engagement feature 154 could comprise one or more bends at or near the end of the second clip portion 153 opposite the bend 155. As illustrated, the second engagement feature 154 can have two separate bent portions. It is anticipated that a plurality of separate bent portions could be used for the second engagement feature 154. The bent portions of the second engagement feature 154 can have a generally U-shaped cross-sectional shape similar to or identical to the bent portion of the first engagement feature 152. Furthermore, the bent portions of the second engagement feature 154 can perform the same or similar functions described above (e.g., friction reduction, tight fitting in the inserts 130 and/or grooves 112) with respect to the engagement feature 152. The engagement features may also provide a biasing force to help the clip stay in place and to secure together portions of the container. This biasing force may be instead of or in addition to any biasing force provided by the overall shape of the clips, as described above.

One or both of the first engagement feature 152 and second engagement feature 154 can include one or more clip release features 156. In some embodiments, the clip release feature 156 comprises one or more protrusions, tongues, or lips, which may include flat unbent portions on the end of the first and/or second clip portions 152, 153 opposite the bend 155. The clip release feature 156 can be used to assist with the removal of the subject clip 150 and/or with removing other clips 150 from an assembled container assembly 100, as explained below. The clip release feature 156 is shown extending from the end of the clip, between the two U- or V-shaped engagement features 154. The clip release feature 156 can be one a side of the clip and may be at the end or at an intermediary position. The clip release feature 156 can have one of many different shapes. As shown, the clip release feature 156 has a low profile and extends over the groove 112 and/or over the inner cavity of the insert 130. As can be seen with reference to FIG. 13, the clip release feature 156 can extend into the opening in the insert, but preferably does not extend past, or completely cover the opening. This allows a user to release the clip by engaging the clip release feature 156 with one of a variety of levers. This can be done without the use of any special tools. For example, another clip, a screwdriver, a shovel, a crowbar, etc. can be advanced under the clip release feature 156 into the groove or insert and then used as a lever to pop the clip out of engagement with the groove or insert. It will be understood that the clip release feature 156 can function in other or similar ways, at different locations. For example, the clip release feature 156 can be located near the end of the clip, but not extending over an opening. The clip release feature 156 can be structured and/or positioned such that a lever can still be placed under the clip release feature 156 and the clip pried off. In other embodiments, the clip release feature 156 can be pulled away from the container to release the clip.

Each of the features discussed with respect to the first and/or second engagement features 152, 154 could apply to the other engagement feature or to both the first and second engagement features 152, 154.

Figure 3A:
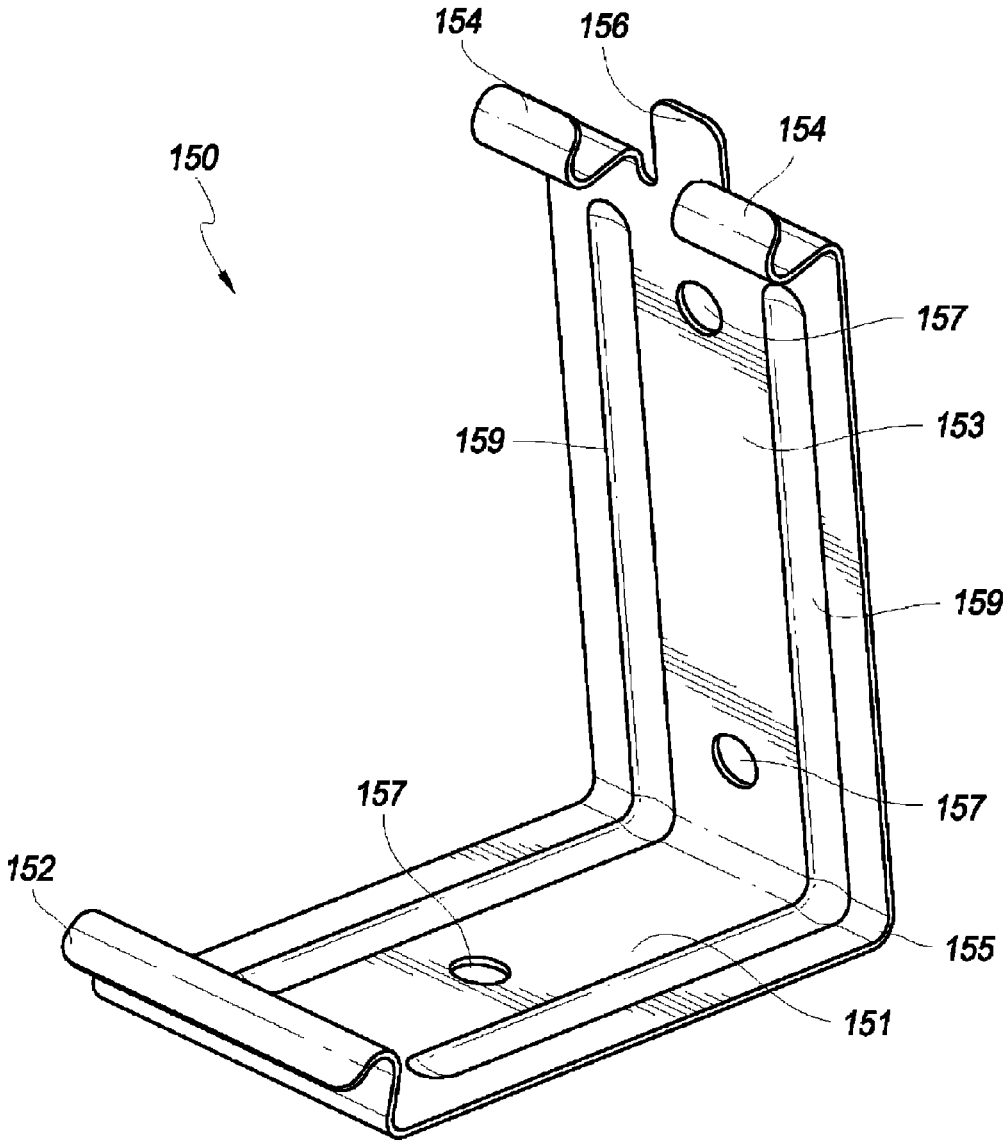
FIG. 3A is a perspective view of another embodiment of clip.
Figure 4A:
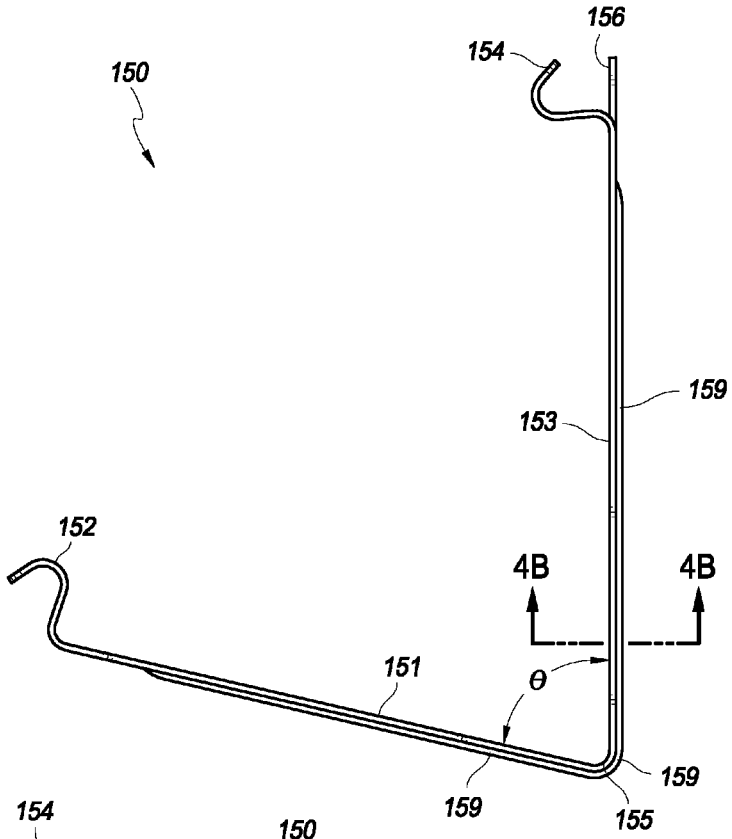
FIG. 4A is a side view of the clip of FIG. 3A.
Figure 4B:
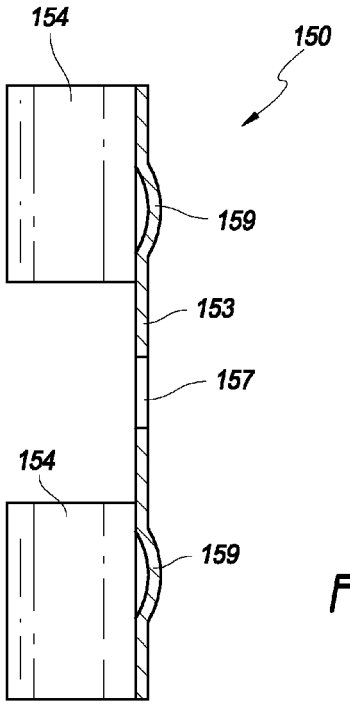
FIG. 4B is a cross-section view taken along the plane 4B-4B of FIG. 4A.
Figure 5:
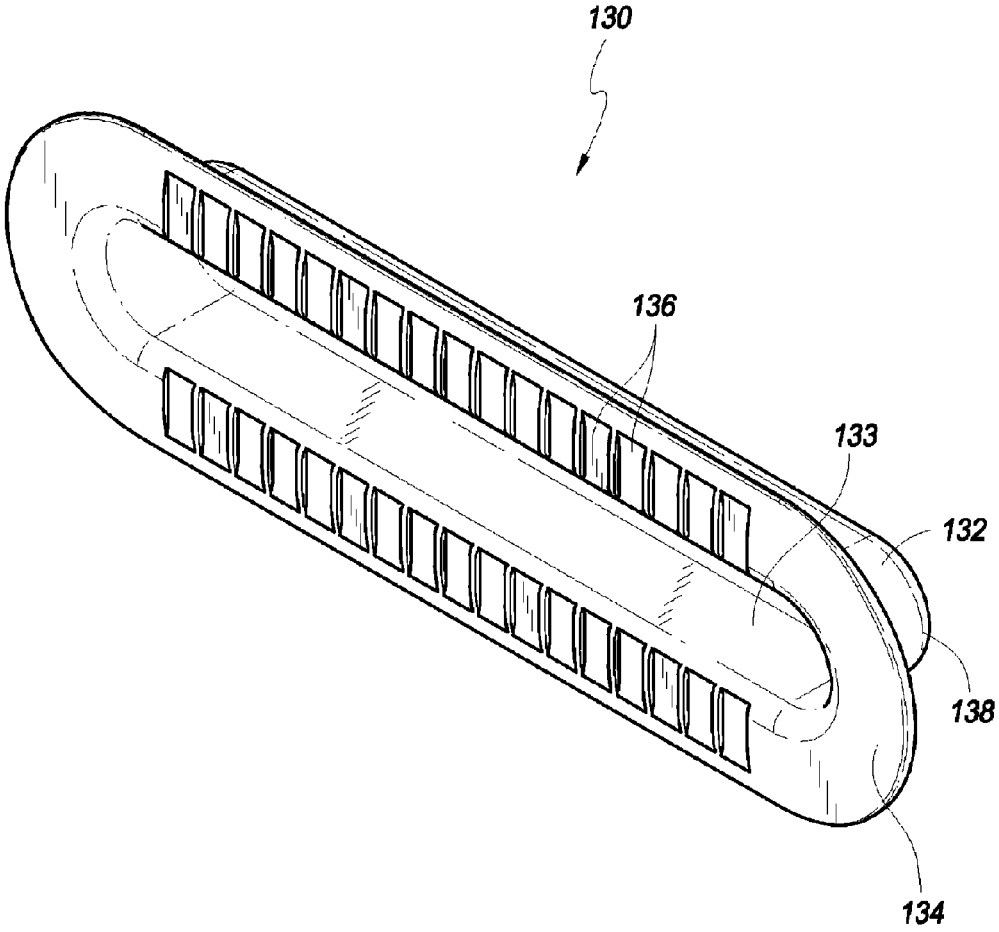
FIG. 5 is a perspective view of an insert.
Figure 6:
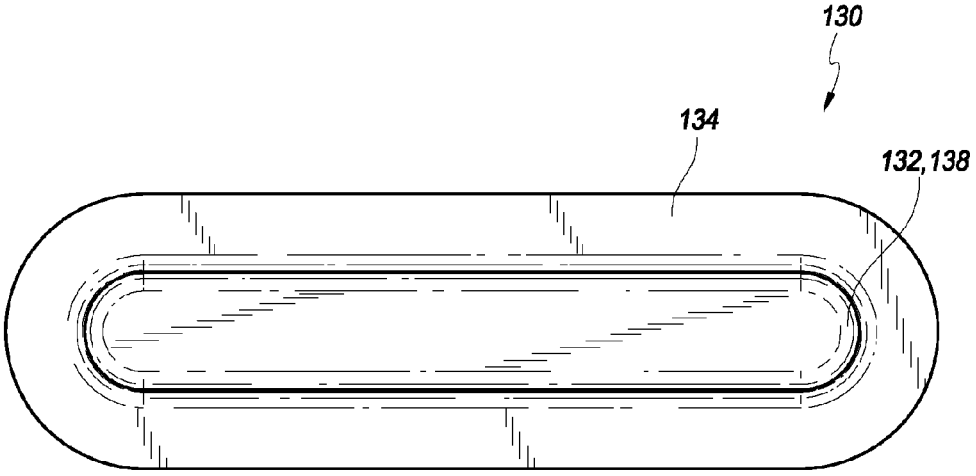
FIG. 6 is a bottom view of the insert of FIG. 5.

In some embodiments, as illustrated, the clips 150 can include one or more surface features 157. The surface features 157 can comprise through holes, as illustrated. In some embodiments, the surface features 157 comprise channels or groove in the surfaces of the clips 150. For example, grooves could be manufactured into the surfaces of the clips 150 to provide for improved grip. Furthermore, one or more ridges 159 can be manufactured onto the surfaces of the clips 150, as illustrated in FIGS. 3A and 4A-4B. Such ridges 159, for example, could extend along the lengths L1, L2 of the first and second clip portions 151, 153 between the first engagement feature 152 and the second engagement feature 154. In some such embodiments, the ridges 159 could extend only along a portion of one or more of the lengths L1 and L2.

As illustrated in FIG. 4B, the ridges 159 can protrude from the exterior side 158*b* of the clip 150. In some configurations, the ridges 159 protrude from the interior side 158*a* of the clip 150. In some embodiments, one or more ridge 159 protrude from the interior side 158*a* of the clip 150 and one or more ridges 159 protrude from the exterior side 158*b* of the clip 150. The ridges 159 can be formed by deforming one or more of the first clip portion 151, the second clip portion 153, and the bend 155. In some embodiments, the ridges 159 are formed of one or more separate portions of material and are adhered to the clip 150 via adhesives, welding, or any other method of adhering known in the art. Surface features 157 and/or ridges can be used to reduce or increase the weight of the clips 150. In some embodiments, the surface features 157 increase or decrease the stiffness and/or strength of portions of the clips 150 (e.g., ridges 159 along the lengths L1, L2 of the clip portions 151, 153 could increase the stiffness of the clips 150).

The clips 150 can be constructed from a range of materials, including plastics, polymers, steel, tin, aluminum, or any other appropriate material or combination of materials. The clips 150 can be manufactured using injection molding, forging, or any other method known in the art. For example, a clip 150 can be manufactured from a single sheet of metal (301 stainless steel, tin, aluminum, etc.). The sheet can be bent to an angle θ to create the bend 155 and the two clip portions 151, 153. One or both of the ends of the sheet can be bent to form, for example, U-shaped engagement features 152, 154. Furthermore one or both of the ends of the sheet can be milled or otherwise processed to separate the end into a plurality of end portions. One or more of the plurality of end portions can be bent to form, for example, U-shaped engagement features 154, as illustrated in FIGS. 3-4. One or more of the plurality of end portions can be left unbent. The one or more unbent portions can be shortened along the length of the respective clip portion 151, 153. In some cases, surface features 157 can be milled, welded, pressed, stamped, or otherwise manufactured onto or into the surfaces of the clip 150.

FIGS. 5-11 illustrate an example insert 130 for use with the container assembly 100. As has been mentioned, the insert 130 can also be used with a number of other articles of manufacture. An insert 130 can help retain a clip 150 within the groove 112 in which the insert 130 is installed. In some embodiments, the insert 130 can help retain the clip 150 in place on the container assembly 100. The insert 130 includes a base 132. The base 132 can be shaped and sized to fit within a groove or slot 112 on the container 100. The base may be received into the groove with a loose or slip fit, or with any of a snap fit, a friction fit or other tight fit. In some embodiments, the base 132 comprises a protrusion that extends from the top face of the insert. As illustrated, in some embodiments, the base 132 has a general cup-like shape with a receiving surface 133 on the interior of the "cup" and a mating surface 138 on the exterior of the "cup." The receiving surface 133 can comprise a recess or cavity.

Figure 9:
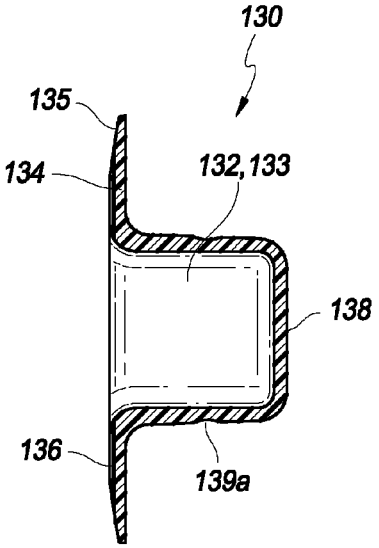
FIG. 9 is a cross-section view of the insert of FIG. 5 taken along plane 9-9 of FIG. 7.
Figure 10:
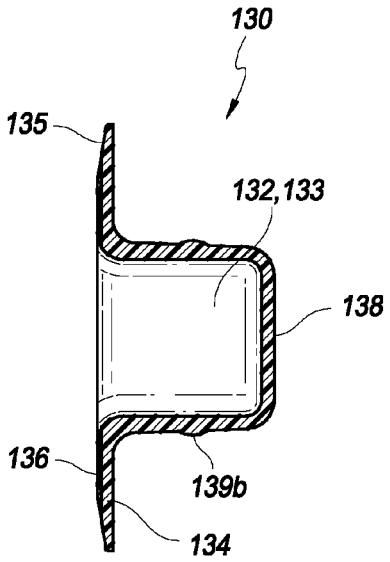
FIG. 10 is a cross-section view of another embodiment of insert.
Figure 11:
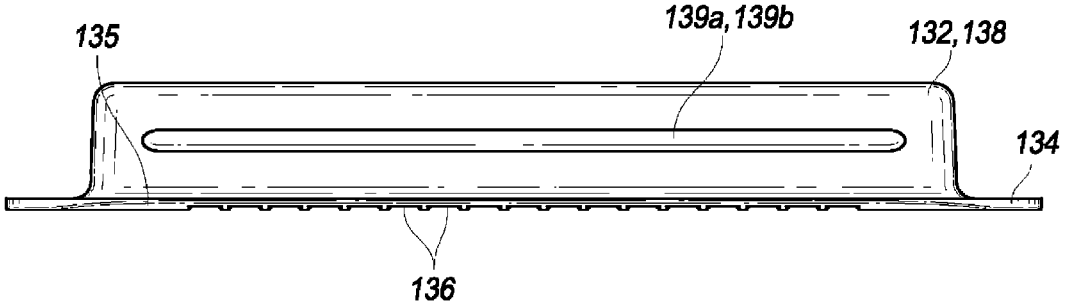
FIG. 11 is a side view of the insert of FIG. 5.

The base 132 can be sized and shaped to fit within one or more of the grooves 112 in the exterior surface 114 of the sides 110 of the container assembly 100. The exterior surface 138 of the insert 130 can include one more mating features. The mating feature can provide many benefits. For example, the mating features can be used to help secure the insert in the groove. As illustrated in FIG. 9, the mating feature can comprise one or more channels or indentions 139*a* in the exterior surface 138. The channels 139*a* can enhance the amount of adhesive that can fit between the exterior surface 138 and the interior surfaces of the grooves 112 in the exterior surface 114 of the sides 110 of the container assembly 100. In some embodiments, the mating feature can comprise one or more ridges 139*b* on the exterior surface 138 of the base 132. The ridges 139*b* may also increase the amount of adhesive that can fit between the mating surface 138 and the interior surfaces of the grooves 112 in the exterior surface 114 of the sides 110 of the container assembly 100. Furthermore, the ridges 139*b* can facilitate a "snap fit" between the insert 130 and the grooves 112 in the exterior surface 114 of the sides 110 of the container assembly 100.

The receiving surface 133 of the base 132 can be sized and shaped to receive the first engagement feature 152 and/or to receive the second engagement feature 154. The base 132 can include a plurality of receiving surfaces. In some such cases, the plurality of receiving surfaces can be configured to receive and engage with a plurality of engagement features 152, 154. For example, the base 132 can include two receiving surfaces configured to receive and engage with the two engagement features 154 on the end of the second clip portion 153 opposite the bend 155. The receiving surface(s) 133 can include surface features (e.g., bumps, grooves, ridges, etc.) configured to enhance the engagement between the first or second engagement features 152, 154 and the insert 130. In some embodiments, the base 132 could be partially, mostly, or completely solid (e.g., having no interior region or interior surface) and may include one or more outwardly projecting features (e.g., ridges, bumps, etc.) with which the first and/or second engagement features 152, 154 are configured to engage. These outwardly projecting features may be used in combination with or instead of the illustrated one or more cavities or recessed portions.

The insert 130 can include a flange portion 134 connected to or unitary with the base 132. The flange portion 132 may define at least a portion of the face of the insert. The flange portion 134 can extend outwardly from the base 132 around at least a portion of a periphery of the base 132. For example, the flange portion 134 may extend in one, two, or more directions from the base 132. As shown, the flange portion 134 extends in four directions from the sides of the base 132. The flange portion 134 can be sized to completely cover the groove 112 in which an insert 130 is installed. In some embodiments, the insert 130 inhibits water or other liquids and/or fluids from accessing the groove 112 in which the insert 130 is installed. The insert 130 may form a water tight or substantially water tight seal with the groove 112 and/or the panel 110. The flange portion 134 may further help prevent liquid from accessing the groove. In the absence of an insert 130, liquid can collect in the groove 112 and cause damage (e.g., rotting, bubbling, warping, etc.) to the groove 112. Inhibiting fluids from accessing the grooves 112 can help reduce the likelihood that the grooves 112 sustain damage, thus increasing the durability and life of the side/panels in which the inserts 130 are used.

The flange portion 134 can have one of many different shapes and cross sections. The flange portion 134 can include a tapered portion 135 around at least a portion of the periphery of the flange portion 134 (see FIGS. 8-10). The tapered portion 135 can help reduce the likelihood that one or more of the first and second engagement features 152, 154 will catch on the flange portion 134 as the engagement features 152, 154 are engaged with the flange portion 134. Furthermore, the tapered portions 135 of the inserts 130 can allow the inserts 130 to have a smooth interface with the outer surface 114 of the side 110 into which the inserts 130 are installed.

Figure 7:
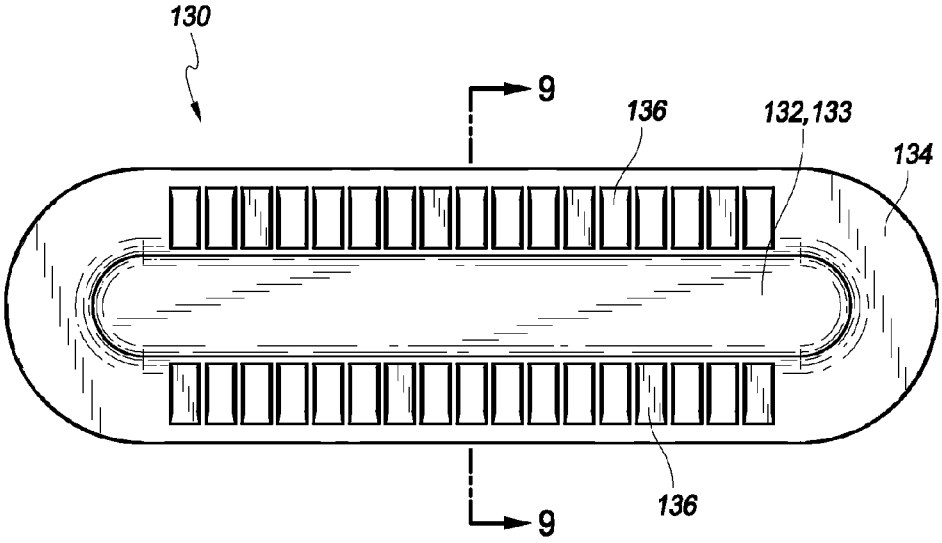
FIG. 7 is a top view of the insert of FIG. 5.
Figure 8:
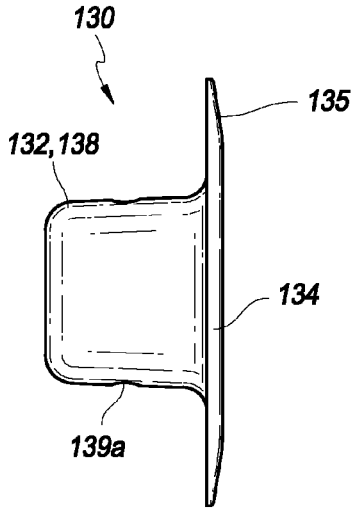
FIG. 8 is an end view of the insert of FIG. 5.

In some embodiments, the flange portion 134 includes a plurality of grooves or other surface features 136 (e.g., ridges, bumps, notches, etc.) as best seen in FIG. 7. The grooves 136 can help prevent the clips 150 from sliding lateral to the inserts 130 when the clips 150 are engaged with the inserts 130. The grooves 136 can also help inhibit the clip 150 from adhering to the insert 130 over time. As can be seen, the grooves 136 can be cut or formed into the face of the insert.

The inserts 130 can be constructed from many materials such as plastic, nylon, metal, or other materials or combinations of materials. The inserts 130 can be manufactured using injection molding or any other process known to those skilled in the art.

The use of insets 130 in the container assembly 100 can increase the life of the sides 110 of the container assembly 100. The grooves 112 are generally the weakest structural point on the sides 110. Inserts 130 can strengthen and protect the grooves 112, thereby increasing the life of a given side 110 and the container generally.

Figure 12:
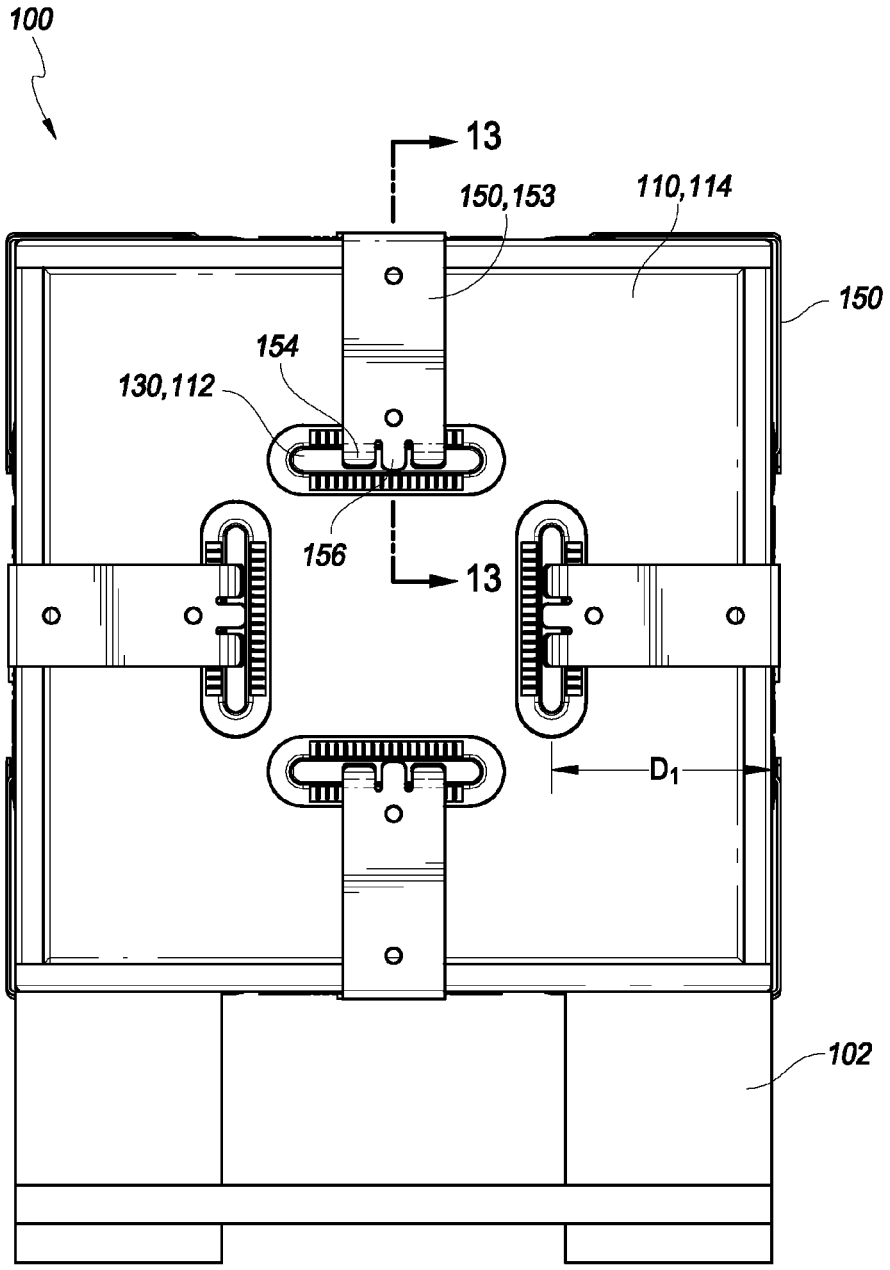
FIG. 12 is a side view of the container assembly of FIG. 1.

Turning now to FIGS. 12 and 13, an assembled container assembly 100 is shown. As illustrated, one or more sides 110 of the container assembly 100 have a plurality of grooves 112. In some embodiments, each groove 112 in a given side 110 is distanced from an adjacent edge of the side 110 by a distance D1. Each groove 112 could be located at a unique distance from its adjacent edge.

As shown in FIG. 12, a side 110 could include one groove 112 associated with each edge of the side 110, allowing for the use of one clip 150 to connect the side 110 with each adjacent side. In some embodiments, one or more edges of each side 110 have a plurality of grooves 112 associated with them. In such embodiments, a plurality of clips 150 and inserts 130 could be used to connect one side 110 with an adjacent side 110.

Each of the sides 110 of the container assembly 100 can comprise a single panel. Such panels could be constructed of many materials, including plywood, metal, plastic, OSB wood, etc. The panels could be coated with plastics or other coatings in order to, in some situations, increase the durability of the panels. In some embodiments, the panels/sides are constructed of non-flammable material.

The use of inserts 130 can enable the use of the panel materials listed above and/or additional materials for the sides 110 of the container assembly 100. In particular, the use of inserts can enable the use of panel materials not previously or typically used as collapsible shipping containers. For example, one or more of the sides 110 can be constructed of a wire mesh or other porous and/or permeable material. The use of such materials can provide a lighter weight container, can allow for ventilation within the container assembly 100 and/or a fireproof container. The inserts 130 can provides structural stability in the vicinity of the grooves 112 in the sides 110 that would otherwise be lacking in the absence of inserts 130. Furthermore, the inserts 130 can increase structural tolerance for rougher and less precise machining for the grooves 112 in the exterior surfaces 114 of the sides 110, which can reduce the manufacturing costs for the sides 110 of the container assembly. The use of inserts 130 can also facilitate the use of lighter and/or less durable materials, such as paper honeycomb and polystyrene. That is, the use of inserts 130 can spread the load applied by the clips 150 across a greater area than that of the clip 150 itself, to inhibit or avoid deformation or damage to the sides 110. Additionally, the use of inserts 130 with a container assembly 100 gives the assembly 100 a unique look and feel.

As illustrated in FIG. 13, the inserts 130 can inhibit the clips 150 from directly contacting the grooves 112. Furthermore, the inserts 130 may also help inhibit the clips 150 from directly contacting the outer surfaces 114 of the sides 110. As previously discussed, the clips 150 can be used to join two sides 110, wherein the two sides 110 meet an angle β. As illustrated, the angle β can be approximately 90°. In some embodiments, the angle β is greater than about 60° and/or less than about 120°. Many variations are possible.

In some embodiments, each of the grooves 112 are located at the same distance D1, D2 from respective adjacent side 110 edges. In such embodiments, clips 150 with identical lengths L1, L2 for the first clip portion 151 and second clip portion 153 can be used. Identical distances D1 and D2 can reduce complications in the assembly process for the container assembly 100 by allowing the clips 150 to be engaged with the slots 130 and/or grooves 112 without matching lengths L1, L2 to distances D1, D2. In some cases, the distances D1 and D2 are not identical. In such cases, used of clips 150 with varying lengths L1, L2 for the first and second clip portions 151, 153 can be required.

For the sake of simplicity, a method for assembling a six-sided rectangular prism container will now be described. Many different container shapes and sizes are contemplated, including but not limited to the shapes cited above.

A method of assembling the container assembly 100 can include selecting a first side/panel 110 having a plurality of grooves 112 in its outer surface 114. The first side/panel 110 can be a bottom and may include a pallet base or other type of base. In some embodiments, the first side/panel 110 and/or subsequent sides/panels 110 include inserts 130 preinstalled within one or more of the grooves 112 of each side/panel 110. In some other embodiments, the assembler would install an insert 130 into one or more of the grooves 112. Upon selection of a first side/panel 110, a second side/panel 110 can then be aligned perpendicular to the first side/panel 110 such that an edge of the first side/panel 110 is adjoined to an edge of the second side/panel 110. Preferably, each of the first and second sides/panels 110 has the same number of grooves 112 adjacent the adjoined edges, with each of the grooves 112 on the first side/panel 110 opposing a corresponding groove 112 on the second side/panel 110 in the same position along the length of the adjoined edges.

One or more clips 150 can then be used to connect one or more of the corresponding pairs of grooves 112, thereby affixing the first side/panel 110 to the second side/panel 110. The one or more clips 150 can connect the one or more pairs of grooves 112 by engaging with the bases 132 of the inserts 130 via the first and second engagement features 152, 154 of the clips 150.

A third side/panel 110 can be aligned perpendicular to both the first side/panel 110 and the second side/panel 110 such that an edge of each of the first side/panel 110 and the second side/panel 110 is adjoined to an edge of the third side/panel 110. Corresponding grooves 112 can be connected to one another using the same method described above with respect to the connection between the first side/panel 110 and the second side/panel 110.

Similarly, a fourth side/panel 110 can be adjoined to any two of the already-assembled side/panels 110. The process outlined above can be continued until six sides/panels 110 are connected to each other to form a container assembly 100 having a rectangular prism shape. In some embodiments, the edges of at least one of the sides/panels 110 are rabbeted to further stabilize the connection between at least two of the sides/panels 110. Such rabbeting 118 is illustrated in FIG. 13.

Disassembly of an assembled container assembly 100 can begin with disconnecting one of the clips 150 from a pair of inserts 130. In some embodiments, a clip 150 can be disconnected from an insert 130 by using any wedge or lever device (e.g., screwdriver, crowbar, etc.) to pry one of the first clip portion 151 and the second clip portion 153 away from the container assembly 100, thus breaking the connection between one of the first engagement feature 152 and the second engagement feature 154 from its corresponding insert 130. An extra clip 150 or a previously removed clip may also be used to remove the attached clips 150. The clip release feature 156 can be engaged by the wedge or lever device, to release the clip. In some embodiments, the clip release feature 156 on at least one end of the removed clip 150 can also be used as a lever to remove the remaining clips 150. For example, the clip release feature 156 of an already-removed clip 150 can be inserted between the exterior surface 114 of a side 110 of the container assembly 100 and one of the first clip portion 151 and second clip portion 153 of a connected clip 150. The already-removed clip 150 can then be used as a lever to lift the first or second clip portion 151, 153 of the connected clip 150 away from the container assembly 100, thus releasing the connected clip 150 from the inserts 130 and/or grooves 112 in which it is installed. Using these methods, each of the plurality of sides/panels 110 of the container assembly 100 can be disconnected from each of the other sides/panels 110.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A collapsible container assembly comprising:

a plurality of sides configured to connect and disconnect to form a collapsible container, each side having an internal surface and an external surface, at least two of the sides having at least one groove in their external surfaces;

a plurality of inserts each insert configured for placement within one of the grooves, each insert having a base portion and a flange portion, the base portion having a mating surface and at least one internal surface, the mating surface configured to engage with the grooves, the flange portion extending outwardly from at least a portion of a periphery of the base portion, the flange portion having an outer periphery, the outer periphery positioned outside the groove when the insert is installed within the groove; and at least one clip, the at least one clip having a general L-shape with two ends, each of the two ends having an engagement feature configured to engage with and to be received into the at least one internal surface of an insert.

2. The collapsible container assembly of claim 1, wherein the container assembly has six sides.

3. The collapsible container assembly of claim 1, wherein the flange portion further comprises a plurality of notches configured to help guide the engagement features into engagement with the inserts.

4. The collapsible container assembly of claim 1, wherein at least one of the engagement features includes a clip release member configured to help release the clip from engagement with the insert.

5. The collapsible container assembly of claim 4, wherein the clip release member is a protrusion on an end of the at least one clip.

6. The collapsible container assembly of claim 1, wherein the inserts are constructed of a polymer.

7. The collapsible container assembly of claim 1, wherein the at least one clip is constructed of steel.

8. The collapsible container assembly of claim 1, wherein the at least one clip comprises at least one ridge that extends from the engagement feature on one end of the clip to and the engagement feature on the opposite end of the clip.

9. The collapsible container assembly of claim 1, wherein the flange portion of each of the plurality of inserts forms a water tight seal with the groove inhibits liquid from entering the groove in which the insert is installed.

10. The collapsible container assembly of claim 1, wherein at least one of the sides is constructed of polystyrene.

11. The collapsible container assembly of claim 1, wherein at least one of the sides is constructed of paper honeycomb.

12. The collapsible container assembly of claim 1, wherein at least one of the sides is constructed of wood.

13. The collapsible container assembly of claim 1, wherein the at least one clip comprises a first clip portion and a second clip portion, the first clip portion and the second clip portion separated from each other by a bend in the clip.

14. The collapsible container assembly of claim 13, wherein the first clip portion and the second clip portion form an acute angle with respect to each other when the clip is not engaged with an insert or with a groove.

15. The collapsible container assembly of claim 1, wherein the flange portion is tapered, a thickness of the flange portion decreasing from the base portion to the outer periphery of the flange portion.

16. A collapsible container assembly comprising:

a plurality of sides configured to connect and disconnect to form a collapsible container, each side having an internal surface and an external surface, at least two of the sides having at least one slot on their external surfaces;

a plurality of inserts, each insert configured to fit within one of the plurality of slots and having a base portion and a flange portion, the base portion configured to fit within one of the slots and the flange portion extending from the base portion and configured to be positioned outside of the slot; and at least one clip, the at least one clip having a first end and a second end, each end having an engagement feature configured to engage with at least one of the plurality of inserts positioned within one of the slots of the plurality of sides.

17. The collapsible container assembly of claim 16, wherein the flange portion further comprises a plurality of notches.

18. The collapsible container assembly of claim 16, wherein the flange portion inhibits liquid from entering the slot in which the insert is installed.

19. The collapsible container assembly of claim 16, wherein at least one of the at least one clips comprises a ridge extending between the engagement feature on the first end and the engagement feature on the second end.

20. The collapsible container assembly of claim 16, wherein the at least one clip has a general L-shape.

21. The collapsible container assembly of claim 16, wherein the flange portion is tapered, a thickness of the flange portion decreasing from the base portion to an outer periphery of the flange portion.

22. The collapsible container assembly of claim 16, wherein the base portion further comprises a cavity wherein the engagement feature of the clip is configured to be received within the cavity.

* * * * *